US010483054B2

(12) United States Patent
Corna

(10) Patent No.: US 10,483,054 B2
(45) Date of Patent: Nov. 19, 2019

(54) MONO OR BIDIRECTIONAL CONTACTOR

(71) Applicant: Telarc S.r.l., Milan (IT)

(72) Inventor: Marco Corna, Almenno San Salvatore (IT)

(73) Assignee: Telarc S.r.l., Milan (IT)

( * ) Notice: Subject to any disclaimer, the term of this patent is extended or adjusted under 35 U.S.C. 154(b) by 0 days.

(21) Appl. No.: 15/946,256

(22) Filed: Apr. 5, 2018

(65) Prior Publication Data

US 2019/0221381 A1 Jul. 18, 2019

(30) Foreign Application Priority Data

Jan. 12, 2018 (EP) ..... 18151326

(51) Int. Cl.
*H01H 9/44* (2006.01)
*H01H 9/34* (2006.01)

(52) U.S. Cl.
CPC ..... *H01H 9/44* (2013.01); *H01H 9/34* (2013.01); *H01H 2223/044* (2013.01)

(58) Field of Classification Search
CPC ..... H01H 9/44; H01H 9/34; H01H 2223/044
See application file for complete search history.

(56) References Cited

U.S. PATENT DOCUMENTS 2,231,973 A 2/1941 Van Valkenburg
2,825,013 A 2/1958 Krenke
4,351,620 A * 9/1982 Stritt ..... H02B 1/052 403/13
4,371,855 A * 2/1983 Lenzing ..... H01H 50/22 29/602.1
4,408,174 A * 10/1983 Seymour ..... H01H 71/46 335/155
4,451,718 A * 5/1984 Yamagata ..... H01H 9/44 218/147
5,196,815 A * 3/1993 Chien ..... H01H 1/54 335/147
5,768,091 A * 6/1998 Vinson ..... H02B 1/052 200/293

(Continued)

OTHER PUBLICATIONS

Eaton Corporation: "AVD DC Control Contractors," Internet, May 2010, the whole document, URL: http://www.eaton.ec/ecm/idcplg?IdcService=GET_FILE&allowInterrupt=1&RevisionSelectionMethod=LatestReleased&noSaveAs=0&Rendition=Primary&DocName=PA05803002E.

*Primary Examiner* — Truc T Nguyen
(74) *Attorney, Agent, or Firm* — Renner, Otto, Boisselle & Sklar, LLP

(57) ABSTRACT

A mono or bidirectional contactor device for applications involving switching of the power supply for high current and/or voltage electrical loads, of the type comprising a containing and protective casing made of synthetic plastic insulating material with a bottom wall from which there extends an actuator portion, comprising a coil and auxiliary contacts, an intermediate portion for housing fixed and movable contact poles, and an upper arc chute portion for dissipating the electric arc. Advantageously the casing is chosen so as to have a flat parallelepiped form with the bottom wall extending at 90° with respect to a side wall of the casing on the shorter side and a support plate for the contactor is connected to the outer surface of the base wall or of said side wall so as to support the casing substantially with a vertical extension from the horizontal plane or projecting from the vertical plane.

28 Claims, 10 Drawing Sheets

(56) References Cited

U.S. PATENT DOCUMENTS

| | | | | |
|---|---|---|---|---|
| 6,292,076 | B1 * | 9/2001 | DeGrazia | H02B 1/052 335/202 |
| 7,199,319 | B1 * | 4/2007 | Rodgers | H01H 71/0214 200/293 |
| 7,202,437 | B1 * | 4/2007 | Rodgers | H01H 1/5822 200/401 |
| 7,403,373 | B2 * | 7/2008 | McCoy | H02B 1/042 200/294 |
| 8,759,697 | B2 * | 6/2014 | Polston | H01H 71/0257 200/293 |
| 2002/0196108 | A1 * | 12/2002 | Millburn | H01H 73/38 335/6 |

* cited by examiner

MONO OR BIDIRECTIONAL CONTACTOR

RELATED APPLICATION

This application claims priority of European Patent Application No. 18151326.8 filed Jan. 12, 2018, which is hereby incorporated herein by reference.

Field of Application

The present invention relates to the structure of an improved mono or bidirectional contactor or remote control switch.

More particularly, the invention relates to a mono or bidirectional contactor for applications involving switching of the power supply for high current and/or voltage electrical loads, of the type comprising a containing and protective casing made of synthetic plastic insulating material with a bottom wall from which there extends an actuator portion, comprising a coil and auxiliary contacts, an intermediate portion for housing fixed and movable contact poles, and an upper arc chute portion for dissipating the electric arc.

Prior Art

As is known in this specific technical sector, a contactor or remote control switch is an electromechanical control device or device generally designed to carry out a large number of operations and able to interrupt a current supplied to an electrical load.

In plant engineering a contactor is normally inserted inside an electric control panel and is used for local operation, not necessarily far from the load being supplied, for example along the lines departing from the said electric control panel. A remote control switch is instead able to be operated at a certain distance from the load, but the components and the internal structures of a contactor and a remote control switch are very similar.

Hereinbelow reference will be made more specifically to a contactor with an improved structure according to the present invention without this being intended to limit the rights of the Applicant with regard to the sector of remote control switches.

A contactor is also referred to as being a monostable device since it has only one rest position, which is not manually operated, being able to establish, support and interrupt currents in overload conditions. The rest position corresponds usually to the open position of the main contacts.

A contactor is distinguishable from a relay in that the latter is normally used for controlling relatively small power supplies or signals in an electronic environment, whereas a contactor is used to control power supplies which may also be very high.

The internal contactor structure houses a coil which, when passed through by a current, attracts towards it a movable element inside the device, thus ensuring that the main or auxiliary contacts which are generally situated in the central part of the contactor may open or close depending on the type of device with which they are associated.

An auxiliary switch or an electronic PLC device is provided in the internal circuit for energizing or de-energizing the coil so as to supply it with direct or alternating current and thus activate the said contactor.

On the market it is possible to find contactors of varying shapes, sizes and rated operating power expressed in terms of both current and voltage capacity for supporting overload conditions.

However, the essential structure of a generic contactor normally comprises the following components: a support base from which an actuator portion comprising the coil and the auxiliary contacts extends, a central part for housing fixed and movable contact poles, and an upper dissipator for dissipating the electric arc which is formed during switching.

Although these components may be found in practically all the types of contactors present on the market, the internal arrangement of these components may vary depending on the manufacturer. There is however a common problem which affects this kind of electrical device.

The movable contact of these contactors is mounted on a control linkage which guides it away from and towards the fixed contact and is associated with a resilient recall spring which is activated during switching and release so as to bring the movable contact rapidly back into a rest position.

The switching step should satisfy two mutually conflicting requirements. On the one hand the movable contact is subject to a relatively high angular deviation so as to ensure sufficient opening for effectively interrupting the current flow without generating an excessive electric arc; on the other hand the opening movement should be as rapid as possible.

It should be taken into account, however, that these contactor devices have relatively large dimensions, weight and volume to such a point that the mass of the movable contact will affect the dimensions and the weight also of the resilient recall spring and therefore its inertia.

As a result the method of installation of the contactor is of fundamental important since it should always be installed vertically in order to ensure a greater operating efficiency.

The normal configurations of the contactors currently proposed by the prior art do not offer, however, features allowing correct installation in all the possible operating situations where the contactor should be installed in a corresponding receiving seat provided by the user.

In other words, the contactors which are currently available on the market do not offer a sufficient degree of versatility and freedom of installation such as to allow adaptation to the different configurations of the receiving seats available at user locations.

SUMMARY OF THE INVENTION

A technical problem underlying the present invention is that of devising a novel and improved configuration of the mono or bidirectional contactor device with structural and functional characteristics such as to allow easy adaptation to any user installation requirement.

The invention provides a contactor device with a modular structure which may be produced in different sizes and with a different rated operating power by means of simple structural adaptation allowing the internal components of the contactor to be provided separately from each other and to be assembled very easily depending on the rated power and size which the contactor should have.

The invention further provides a contactor device which can be manufactured on a large scale at a relatively low cost, offering various ways of interconnection to the electric network circuit in which the contactor should be inserted. A proposed solution according to the present invention is that of providing a modular contactor structure in which the containing and protection casing has at least two walls, for example a bottom wall and a side wall, which are arranged at 90° relative to each other so that it is possible to associate alternatively with one of them a support plate which allows the correct installation of the contactor according to the user's requirements.

On the basis of this proposed solution the technical problem is solved by a first embodiment of the present invention relating to a mono or bidirectional contactor device for applications involving switching of the power supply for high current and/or voltage electrical loads, comprising

- a containing and protective casing made of synthetic plastic insulating material with a bottom wall from which there extends an actuator portion, comprising a coil and auxiliary contacts,
- an intermediate portion for housing fixed and movable contact poles, and
- an upper arc chute portion for dissipating the electric arc;
- said casing having a flat parallelepiped form with said bottom wall extending at 90° with respect to a side wall of the casing on the shorter side
- a support plate for the contactor being connected to the outer surface of the bottom wall or of said side wall so as to support the casing substantially with a vertical extension from the horizontal plane or projecting from the vertical plane.

Advantageously, the bottom wall of the casing is connected to a side wall with a right-angled corner.

Moreover, the arc chute portion occupies a quadrant of the parallelepiped form which is situated at the top and/or side with respect to said bottom wall and/or said side wall.

More particularly, the arc chute portion is a segment of predefined angular extension mounted in a quadrant of said parallelepiped shaped casing.

This predefined angular extension is a 90° circle segment.

This segment is substantially a protrusion at the corner and on the side, having dimensions depending on the electric arc dissipation capacity and projecting beyond the side walls of the contactor casing, except for the shorter side. Moreover, the segment has a curved outer surface.

It should also be noted that the support plate has preferably a longitudinal extension greater than the longitudinal extension of the base or the longitudinal extension or height of said side wall of the casing.

Advantageously, moreover, the contactor according to the present invention comprises a cavity along at least three sides of the casing for receiving at least one electrical interconnection strip intended to electrically connect respectively the fixed pole or the movable pole to a corresponding electrical contact terminal which is accessible on the outside of the contactor 1 for connection to an electrical power supply network.

In greater detail, two strips are provided: one for the fixed pole and one for the movable pole, said strips being housed inside respective sections of said cavity, and the aforementioned terminals, i.e. only the free ends of each strip, projecting through associated outlet openings in said casing.

The characteristic features and advantages of the contactor device according to the invention will emerge from the description, provided hereinbelow, of a non-limiting example of embodiment thereof with reference to the accompanying drawings.

DETAILED DESCRIPTION

With reference to these figures, 1 denotes overall and schematically represents an improved mono or bidirectional contactor device in accordance with the present invention.

The device 1 may also be likewise used as a remote control switch without this constituting any limitation of the Applicant's rights.

In the present application below, the following directional terms "vertical", "horizontal", "front", "rear", "forwards", "backwards", "left-hand", "right-hand", "transverse", "upwards" and "downwards" as well as any other similar directional terms refer to those directions which are determined in relation to a user (for example an installation engineer) standing in front of the contactor device according to the present invention. Consequently, these terms, as used to describe the contactor 1, should be interpreted with reference to a hypothetical installation environment which is erect or extends upwards from a horizontal surface.

The contactor device 1 is expressly provided for industrial and/or railway applications where a high direct current or alternating current should be switched, in some cases with a high switching frequency. For these purposes, the contactor 1 may be installed on power supply lines, railway transportation lines, electromagnetic brakes, heating or air-conditioning systems and plants, or may be applied as a power switch or converter.

Just to give a rough idea of the operating conditions in which this kind of device is advantageously required to operate it is pointed out that a contactor of the type described here should be able to interrupt effectively high DC or AC currents, for example ranging from 110 to 1000 thermal amps, in operating conditions which may vary from 750 to 3000 volts.

Moreover, these operating conditions may refer to a single contactor pole. In many configurations it is necessary, however, to provide a two-pole or even a three-pole configuration.

Figure 7:
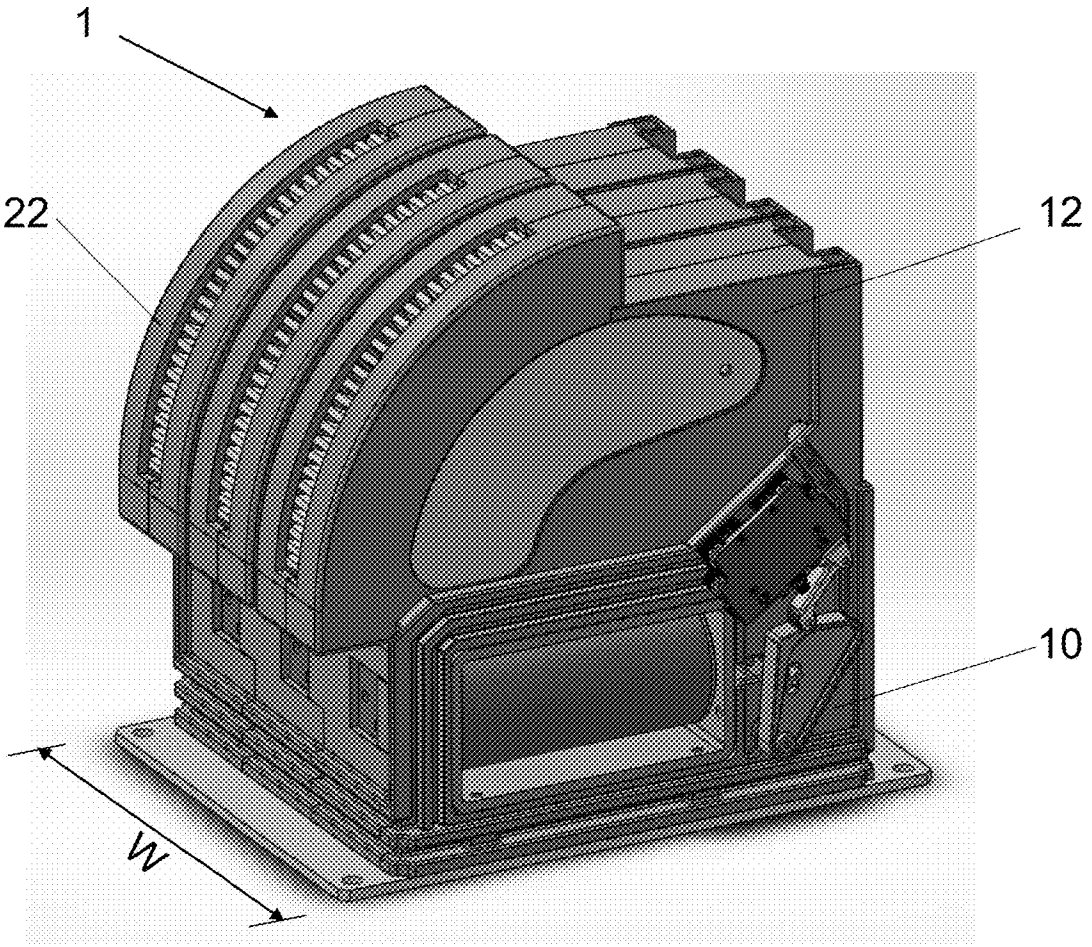
FIG. 7 shows a schematic perspective view of an example of a multipole contactor provided with a plurality of modules, each corresponding to the structure shown in FIG. 1.
Figure 8:
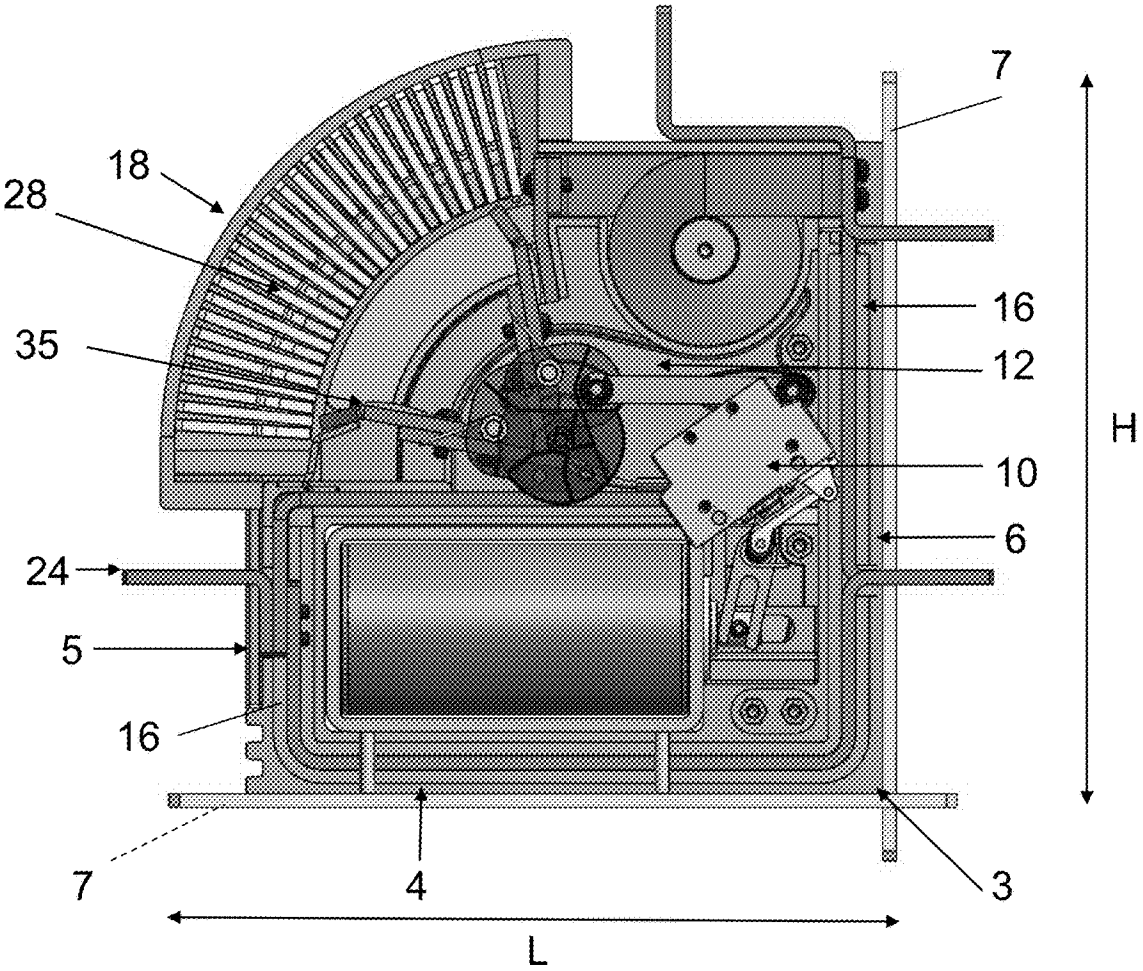
FIG. 8 shows a very schematic side view of a contactor according to the invention in an operative rest condition with the contacts open.

Consequently, the contactor 1 has a modular structure which has a basic single-pole configuration which may be duplicated or triplicated by assembling the internal components of two or three modules parallel to each other, as shown for example in FIG. 7 which shows a three-pole configuration.

Advantageously, the thickness W resulting from the side-by-side arrangement of three modules with a unitary thickness S is less than a multiple of S owing to the common base and the absence of the side walls of the associated casings.

Hereinbelow we shall describe, however, the structure of a single pole included in a single module.

Advantageously, according to the present invention, the contactor 1 comprises a casing 2 which contains and protects all the component parts of the said contactor, including the fixed and movable contacts 30 and 35 which will be described below.

The casing 2 is made of a synthetic plastic material having a predetermined thermal and electrical insulation coefficient.

Moreover, the casing 2 may be formed by two half-shells with matching shapes which are assembled together at the end of assembly so as to enclose the internal components of the contactor 1.

This casing 2 is designed with an essentially flat parallelepiped form having a bottom wall 4 extending at 90° with respect to a side wall 6 of the casing on the shorter side. A support plate 7 for the contactor is connected to the outer surface of the bottom wall 4 or of said side wall 6 so as to support the casing 2 substantially with a vertical extension from the horizontal plane or projecting from the vertical plane.

The parallelepiped form of the casing 2 has at least one right-angled corner 3. More particularly, this right-angled corner 3 is a corner at the base.

More particularly, the casing 2 has a bottom wall 4 which is substantially flat and from which two opposite side walls 5 and 6 extend upwards.

At least one of these side walls, the wall 6, extends upwards from the base 4 forming the right-angled corner 3.

This justifies the fact that the two walls 4 and 6, i.e. the bottom wall and side wall, are arranged at 90° relative to each other.

This configuration has the advantage that it allows the casing 2 of the contactor 1 to be equipped with a support plate 7 connected and/or fastened to the flat base 4.

The support plate 7 is a metal plate with an elongated rectangular shape and has through-holes 8 which are each arranged in the vicinity of a corner end of the plate 7 so as to allow connecting bars (not shown in the drawings) to pass through, these being intended for assembly of the contactor 1 in a special receiving seat.

Figure 3:
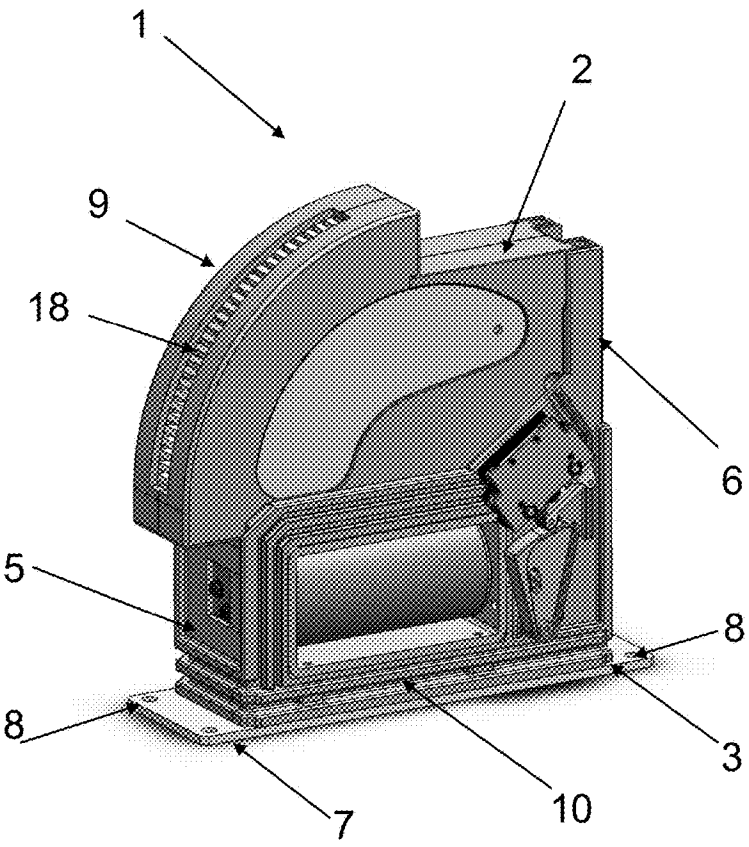

Preferably, the support plate 7 has a longitudinal extension XL greater than the longitudinal extension L of the base 4 of the casing 2 and the holes 8 are accessible on the outside of the volume of the casing 2, as shown in FIG. 3.

Figure 4:
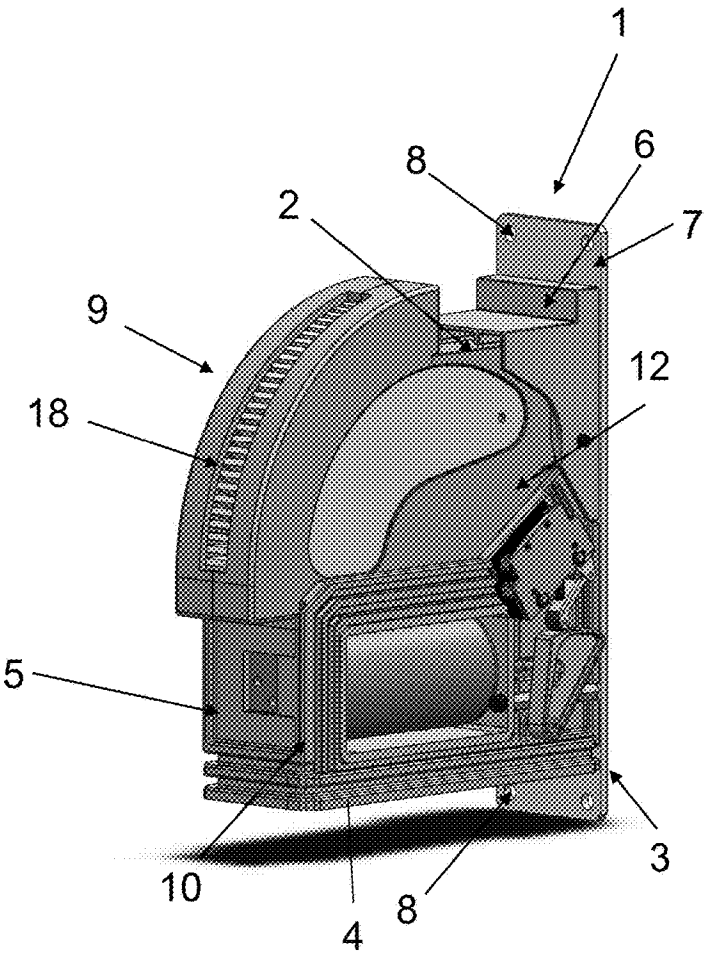
FIGS. 3 and 4 show respective schematic perspective views of the contactor according to the invention in two different installation conditions.

Advantageously and alternatively, the metal plate 7 may be fastened to the outer surface of the side wall 6. In this case also, preferably the longitudinal extension XL of the plate 7 is greater than the maximum extension or height H of the side wall 6 and the holes 8 are accessible on the outside of the volume along the vertical extension or elevation of the casing 2, as shown in FIG. 4.

In a preferred embodiment the extensions L and H are identical and this means that the casing 2 comprises at least two sides with the same dimensions and has the appearance of a flat parallelepiped of thickness S having larger surfaces with a substantially square shape. The thickness S is a fraction of the dimensions L or H.

There are many, alternative, ways of fastening the metal plate 7 to the base 4 of the casing 2 or to the side wall 6. They may in fact be joined together by means of gluing or by means of a removable fastening system using fixing screws or also by means of an interlocking joint.

These different joining systems do not limit the present invention in any way; what is important is the possibility of joining the metal plate 7 to the outer surface of the base 4 or to the outer surface of the side wall 6 depending on the installation requirements of the contactor device 1.

In many applications, in fact, the contactor device 1 is installed and fastened inside a special seat in an electric control panel or protection cabinet, extending upwards from a horizontal surface and, in this case, the configuration shown in FIG. 3 is to be preferred.

Alternatively, if the contactor device 1 should be installed projecting, the configuration shown in FIG. 4 is preferred, where the support plate 7 extends along a vertical plane. In both cases the casing 2 is installed substantially with a vertical extension or elevation.

Figure 6:
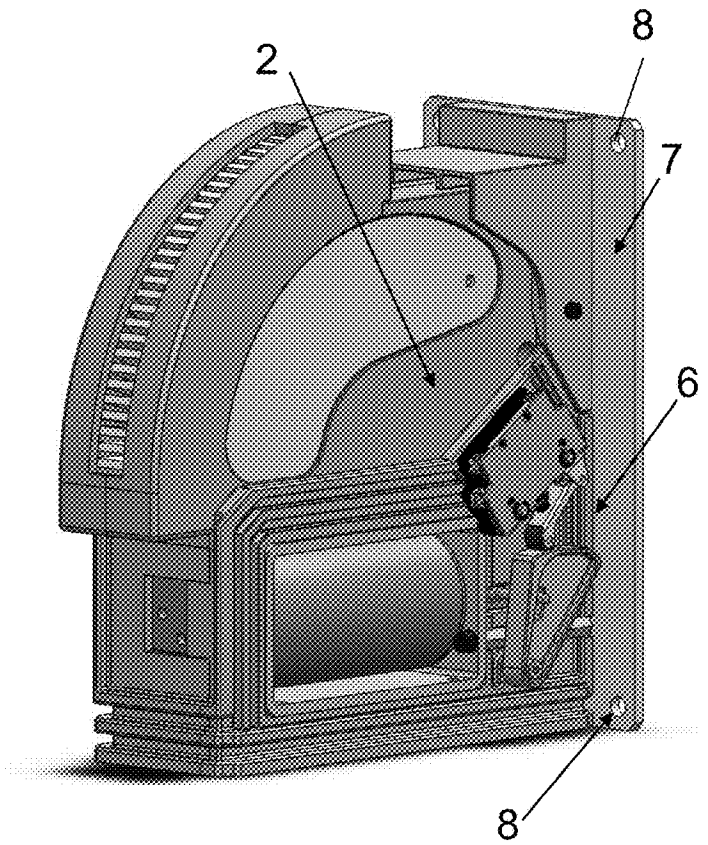
FIGS. 5 and 6 show respective schematic perspective views of the contactor according to the invention in two further different installation conditions.
Figure 5:
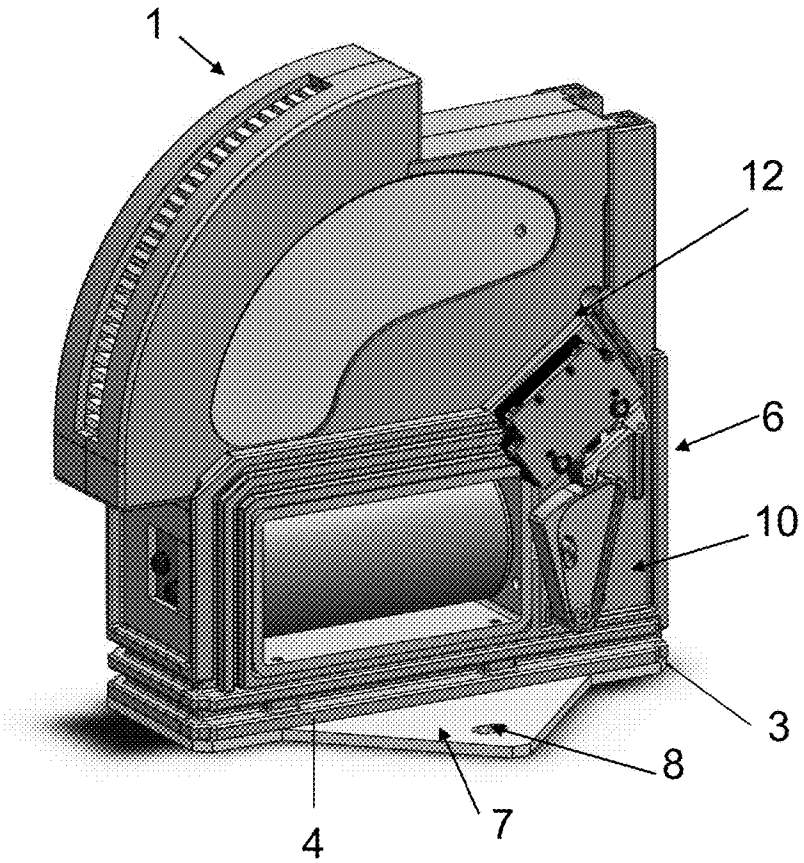

In order to increase the versatility of installation, the support plate 7 may be provided in different shapes and sizes, for example square or rhombus shaped, as shown in FIGS. 5 and 6. In this case the maximum extension of the plate 7 may also be less then the dimensions L or H, but the holes 8 are always accessible on the outside of the lateral volume of the casing 2.

Considering now the internal structure of the contactor 1, this device may be regarded as being divided into three main portions, cooperating with each other, but confined within a corresponding number of parts or portions of the casing 2.

A first base portion 11 comprises an actuator which includes a coil 15 and auxiliary contacts 20. The coil 20 extends with its greater longitudinal axis parallel to the bottom wall 4, while the auxiliary contacts are mounted internally in the region of the side wall 6.

This first portion occupies the bottom of the contactor 1, i.e. that part situated next to the base surface 4.

A second intermediate or central portion 12 comprises at least one movable contact pole 35 guided from and towards a fixed contact pole 30. A so-called blow-out coil 40, described in further detail below, also forms part of this second portion 12. This intermediate portion 12 is bounded by side walls 5 and 6.

A third end portion 18 is occupied by a so-called "dissipator" or "arc chute" for dissipating the electric arc which is formed during the breaking operation.

According to the present invention the third arc chute portion 18 is advantageously formed in a quadrant 9 of the casing 2 opposite the right-angled corner 3.

Moreover, the outer surface 22 of this portion 18 is curved; preferably, the angular extension of this portion 19 is equal to a 90° circle segment and the extension of the curved surface corresponds to a 90° circle arc.

In other words, the arc chute portion 18 is a segment 28 with a predefined angular extension mounted in a quadrant of said parallelepiped shaped casing 2.

This segment 28 is removably assembled in a top corner of the parallelepiped form of the casing 2, i.e. the corner furthest from the support plate 7. Moreover, the outer surface 22 of this segment 28 is curved.

The figures do not show in detail the pole shoes which normally extend from the opening space between the contact poles and the centre of the arc chute portion 18. These pole shoes are variable depending on the voltages involved and therefore the electric arc extinction requirements and the dimensions of the segment 28.

It should be noted that this segment-like arc chute portion 18 may be expanded along its angular extension so as to form a lateral and angular protrusion depending on the housing requirements of the electric arc dissipator elements which are related to the nominal dissipation capacity which the contactor 1 should have, while maintaining the curved outer surface 22.

Figure 14:
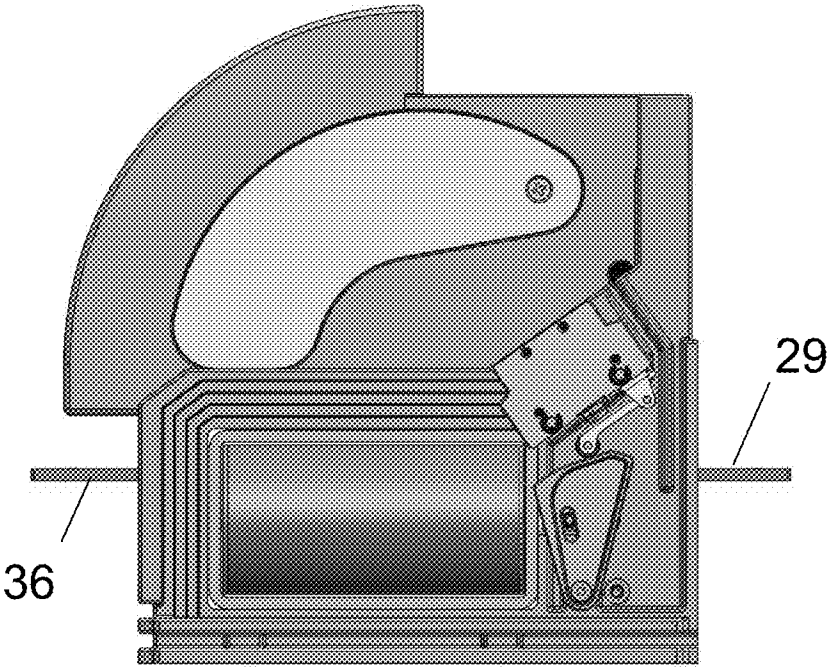
FIGS. 13 and 14 show respective schematic side views of two different examples of embodiment of the contactor device according to the invention.
Figure 13:
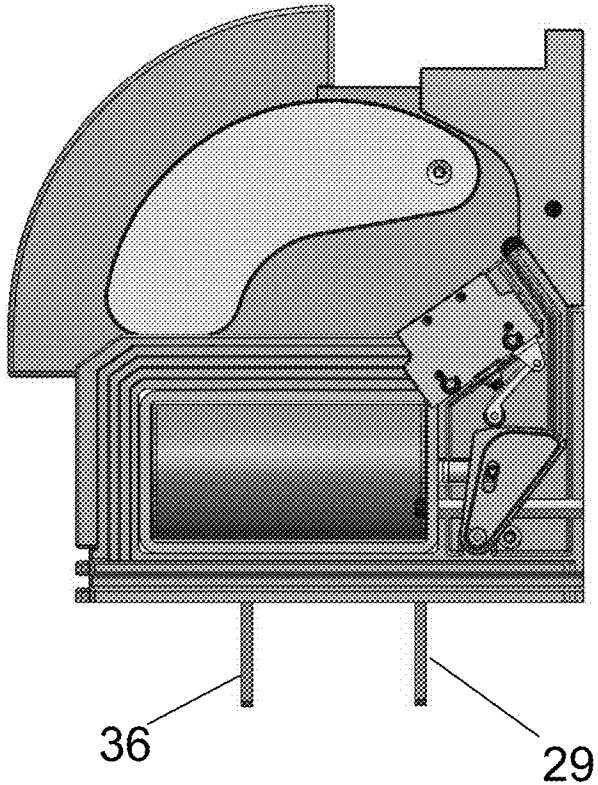
Figure 16:
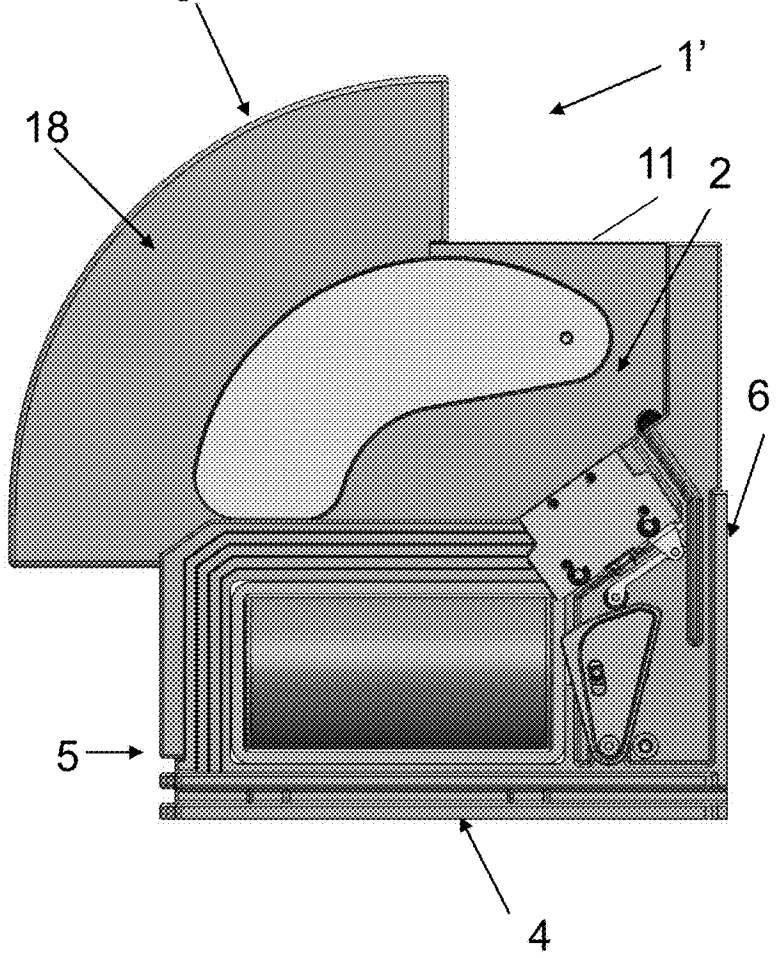
FIGS. 15 and 16 show respective schematic side views of two further examples of embodiment of the contactor device according to the invention.
Figure 15:
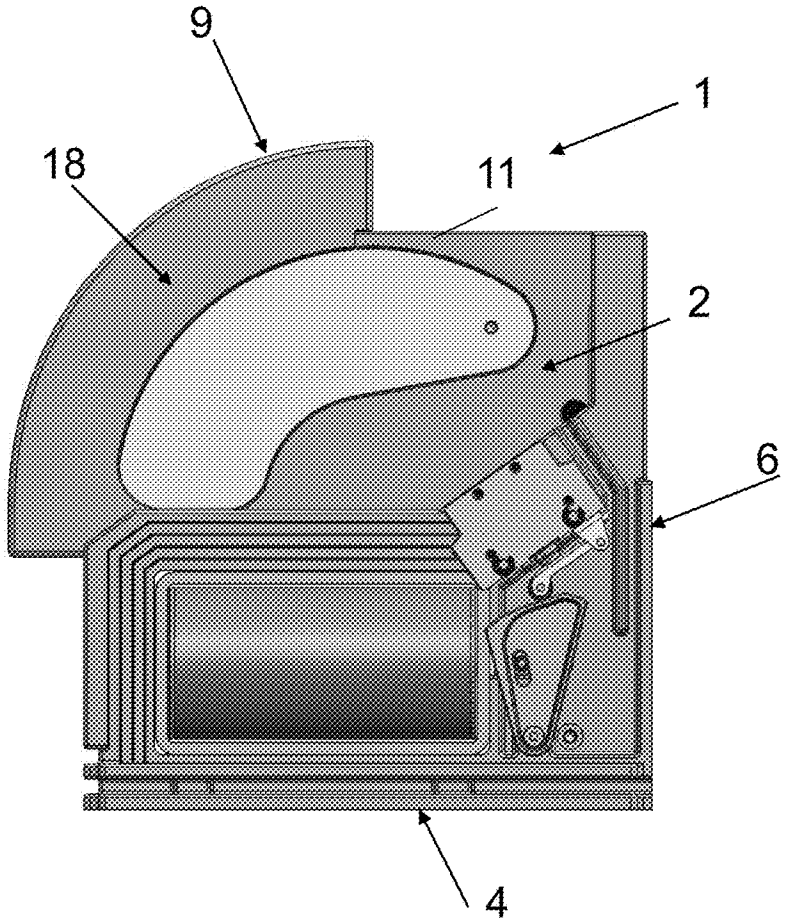

This situation is clearly shown in the comparative example of FIGS. 13 and 14. The first FIG. 13 shows a top end corner portion 18 which remains within the limits of a quadrant 9 of the parallelepiped form of the casing 2, for example for use of the contactor 1 up to a maximum value of 750 volts.

FIG. 14 shows instead in schematic form an end portion 18 which is increased or expanded in the angular and lateral direction beyond the normal dimensions of the quadrant 9 of the casing 2; this configuration is designed to house a dissipator able to be used for a nominal operating power of up to 1500 volts.

It is also possible for this expansion or extension of the free top corner of the parallelepiped form of the casing 2 to assume dimensions which are even greater, for example so as to cater for a maximum operating value of up to 3000 volts.

In this case, the projection and lateral protrusion of the quadrant 9 would be greater than that schematically shown in FIG. 14 and would extend significantly beyond the side wall 5 delimiting the intermediate portion 12 of the contactor 1.

The arc chute portion 18 can therefore be identified also as being a segment having a form equal to a 90° corner segment mounted in a quadrant of the casing 2. This segment may have dimensions which are vary from each other, but in any case may be incorporated substantially by means of interlocking engagement depending on the need to fit the contactor 1 with a dissipator 18 having a greater dissipation capacity.

It is understood, however, that the segment 28 may have different larger dimensions of the corner segment, but retains the same dimensions as regards the thickness S or dimension of the shorter side.

According to another aspect of the present invention a cavity 16 is provided along at least three sides of the casing 2.

This cavity 16 is intended to house a pair of electrical interconnection strips 23, 24 intended to electrically connect together respectively the fixed contact 30 or movable contact 30 and a terminal accessible on the outside of the contactor 1 for connection to the electrical power supply network.

More particularly, both the fixed pole or contact 30 and the movable pole or contact 35 of the intermediate portion 12 of the contactor preferably require a connection to the external electrical power supply network. Internally, the poles 30 and 35 are connected to respective strips 23, 24 by means of conventional braids 32 made of copper or other metal which is a good electrical conductor.

Figure 10:
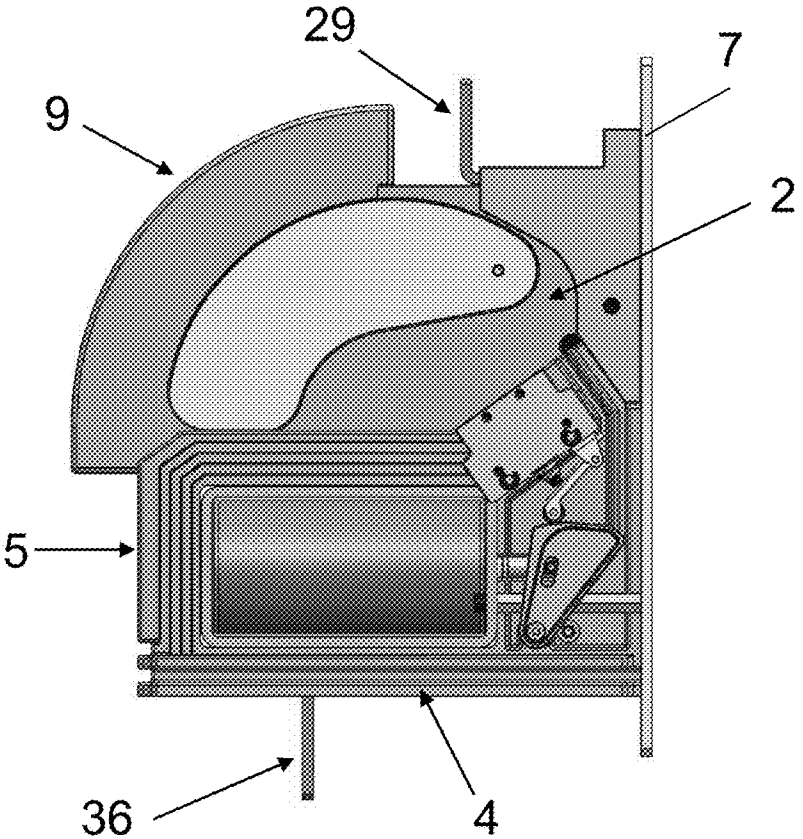
FIG. 10 shows a schematic side view of the contactor device according to the invention with the terminals for interconnection to the electrical network highlighted.

A terminal is provided for each contact 30 or 35 which is accessible and projects on the outside of the casing 2. For example, as shown in FIG. 10, a terminal 29 is provided in the region of the fixed contact 30; this terminal 29 projects through an opening (not shown) formed in the region of the cavity 16 passing inside the top wall 11 of the casing.

Similarly, a terminal 36 is provided in the region of the fixed contact 35 and projects through an opening (not shown) formed in the region of the cavity 16 passing inside the side wall 5 of the casing 2.

Each of the terminals 29 and 36 may be regarded as being the end part, projecting from the casing 2, of the respective strip 23, 24 for internal interconnection with the respective fixed contact 30 or movable contact 35.

Figure 9:
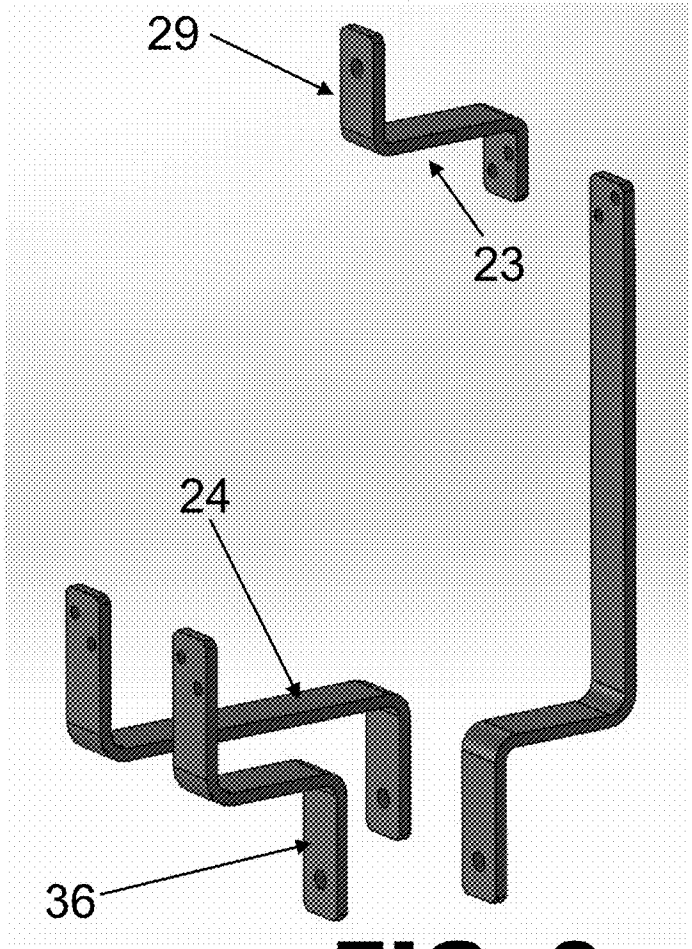
FIG. 9 shows a schematic perspective view of a component of the contactor device according to the invention.

Essentially, the structure of the contactor 1 has two strips 23 and 24, one for the fixed pole 30 and one for the movable pole 35, said strips being housed inside respective sections of the cavity 16, and the terminals 29 and 36, i.e. only the free ends of each strip 23, 24, projecting through corresponding outlet openings in the casing 2. FIG. 9 shows two examples of embodiment of these strips 23 and 24 which are however provided purely by way of example and are intended to show the right-angled bends which these strips may have in order to adapt to the internal shape of the cavity 16 so as to be able to extend internally between a fixed or movable pole 30, 35 and the associated output terminal 29, 36 formed at the free end of the said strip.

Advantageously, the possibility of housing the strips 23 and 24 inside the cavity 16 provides the user with different interconnection configuration options. For example, it is possible for the two terminals 29 and 36 to project on the same side of the contactor 1, namely for example from the side wall 6, when the contactor has the plate 7 fixed to the bottom wall 4, as shown schematically in FIG. 13.

Similarly, it is possible to provide the outlet opening for the terminal 36 along the bottom wall 4 and the outlet opening for the terminal 29 on the top of the contactor 1 when the plate 7 is associated with the side wall 4, as shown in FIG. 10.

Figure 12:
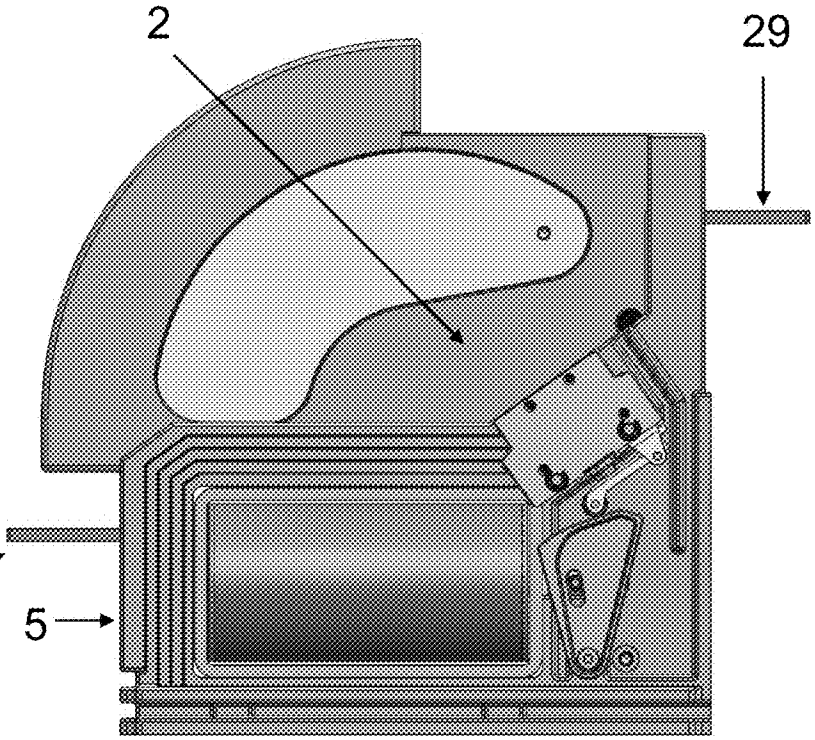
FIGS. 11 and 12 show further schematic views of other examples of embodiment of the terminal configuration shown in FIG. 10.
Figure 11:
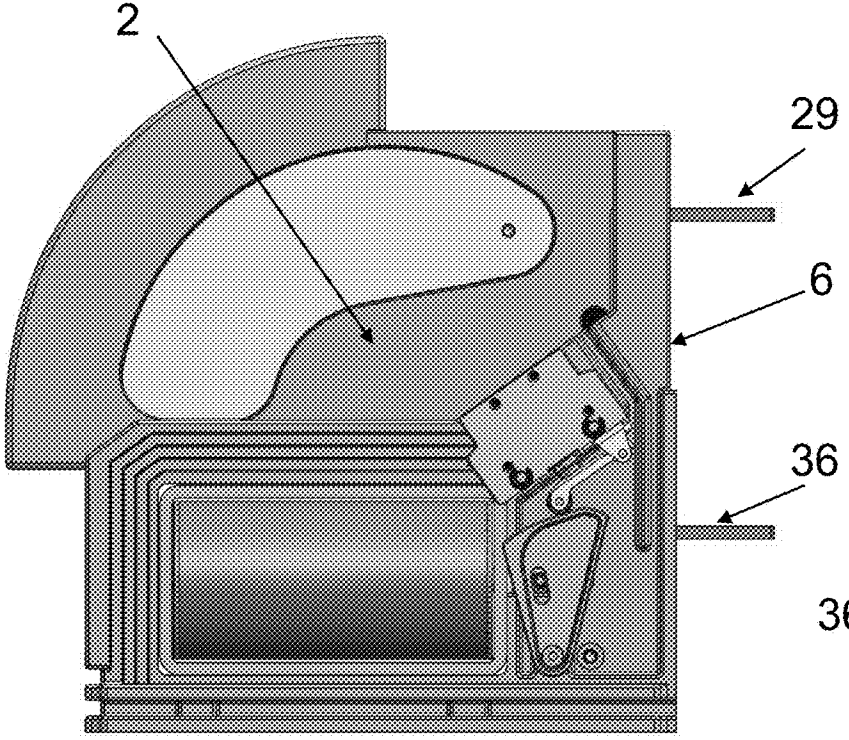

Other configurations may be provided, such as that shown in FIG. 12, without this constituting a limitation for the rights of the Applicant.

The last feature to be described is the internal configuration of the release mechanism which involves the coil 15, the auxiliary contacts 20 and the control linkage for guiding the movable contact pole 35 towards the fixed contact 30.

It should be noted that the contactor device 1 according to the present invention is preferably a magnetic blow-out contactor where a coil 40 is situated in the vicinity of the fixed pole 30 for helping extinguish the electric arc which may be generated during opening of the contacts.

More particularly, the zone of the intermediate portion 12 in which the poles 30 and 35 are provided is subject to a strong magnetic field emitted by the coil 40, and the Lorentz force produces a deviation of the ions of the electric arc between the poles from their trajectory in the arc. The coil 40 may be crossed by the same current which is to be interrupted (direct blow-out) or may be immediately activated when the contact poles have been opened and separated from each other (indirect blow-out).

The blow-out coil 40, situated in the vicinity of the fixed pole 30, is housed in the top part of the intermediate portion 12 of the contactor, laterally with respect to the quadrant 9 occupied substantially by the arc chute portion 18.

The fixed pole 30 is situated between the segment 28 of the dissipator or arc chute and the blow-out coil 40.

The movable pole 35 is instead arranged in a near horizontal position when the contact poles are open and is equipped with a conventional resilient recall spring 27.

The distance between the fixed pole 30 and the movable pole 35 is chosen preferably at at least 40 mm, without this being intended to be limiting in any way. In fact, in the case of other higher power levels this distance may be at least 70 mm.

Figure 1:
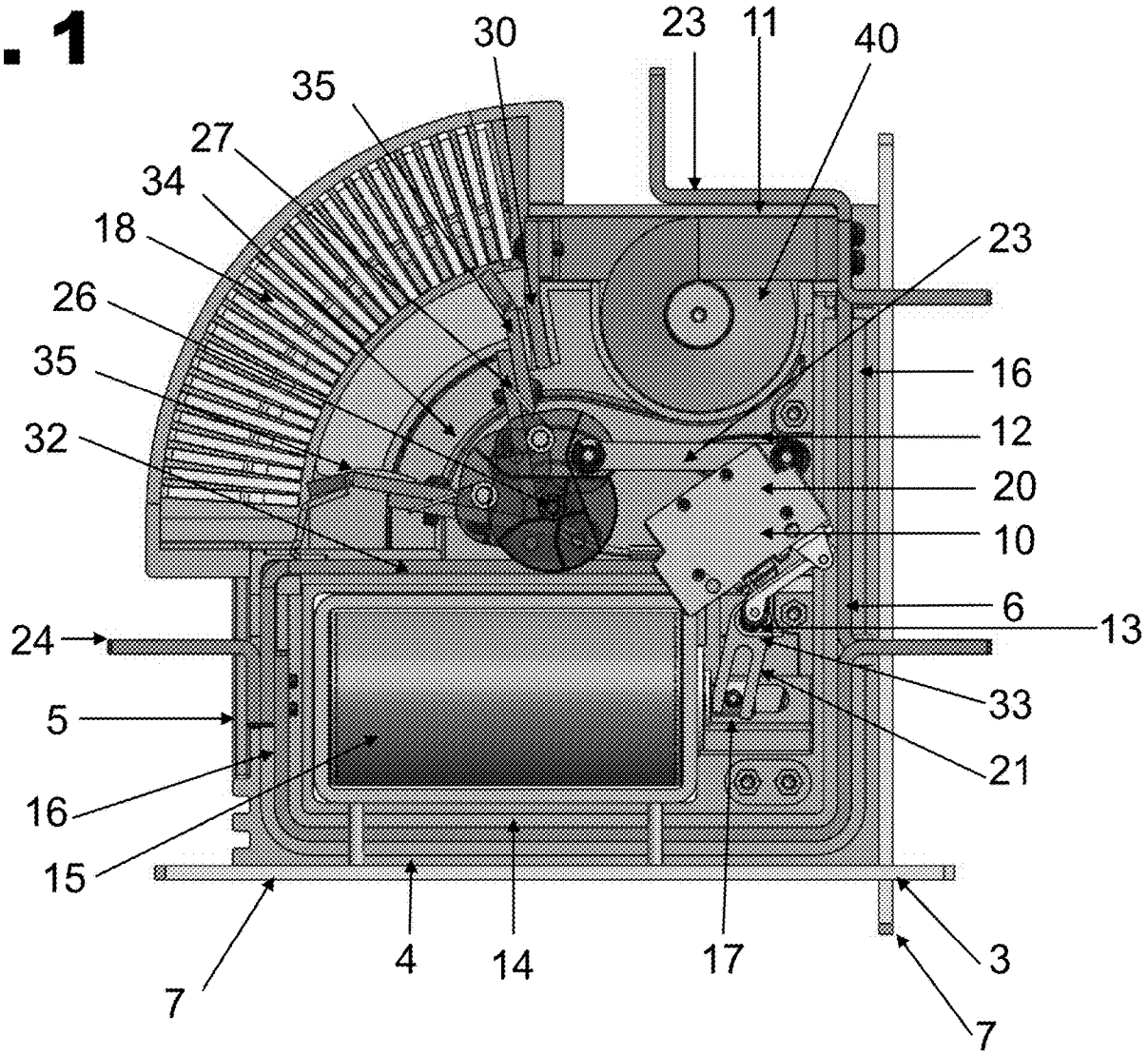
FIG. 1 shows a very schematic side view of a modular mono or bidirectional contactor designed in accordance with the present invention.
Figure 2:
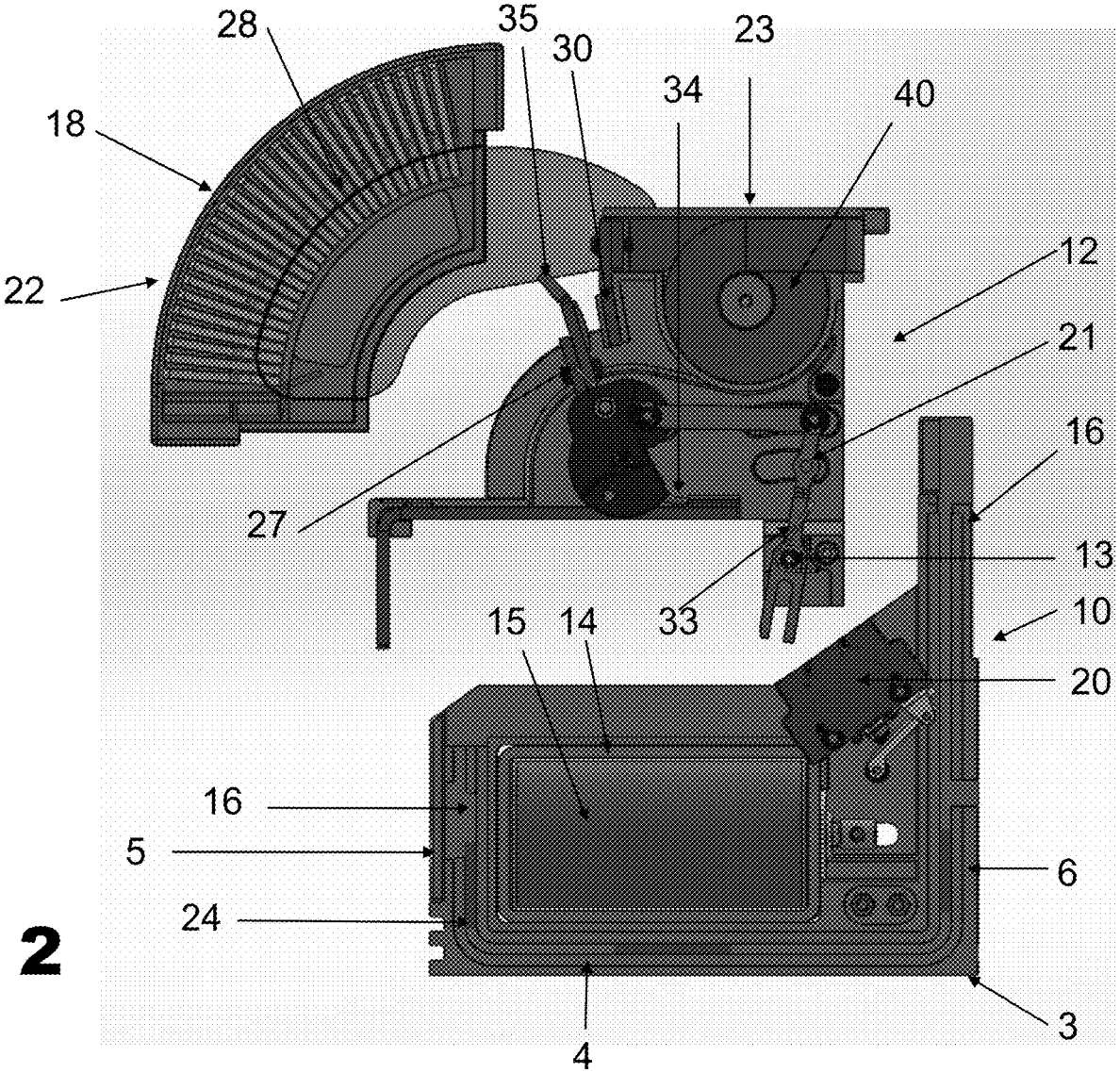
FIG. 2 shows a schematic exploded view of the contactor according to FIG. 1.

FIG. 1 schematically shows both the rest position of the movable pole 35, when the contact poles are open, and the operating position into which the movable pole 35 has been guided to make contact with the fixed pole 30.

The movable pole 35 is pivotably mounted on a pin 26 situated centrally in the intermediate portion 12 of the contactor 1 and a guiding linkage 34 comprises a rod 21 having one end pivotably mounted at a point 13 of the actuator portion 10 of the contactor 1 and an opposite end acting on the movable pole 35 by means of a connecting arm 23.

More particularly, the control linkage 34 comprises a contact support element which is movable and angularly displaceable, being mounted on a pair of outer disks pivotably mounted on small bearings. The arm 23 for connection to the rod 21 is attached to these disks.

The angular deviation of the rod 21 occurs against the action of a resilient recall spring 33.

The stem 17 of the coil 15 of the actuator portion 10 acts on a section of rod 21 situated in the vicinity of the pivoting point 13 and along the trajectory of contact with the auxiliary contacts 20. The linear deviation of the stem 17 may be for example 8 mm.

The coil 20 has been chosen with an oblong configuration, for example with a length of 110 mm as opposed to a diameter of 45 mm, with an extractable external sleeve.

In fact the coil 20 is protected inside the protective housing 14 accessible on one side of the contactor 1, for example on the side where there is the wall 5, opposite to the position of the auxiliary contacts 20.

The coil 20 may be easily removed from the protective housing 14 and replaced with another larger-inductance coil. This may result in an elongation of the dimensions L and H of the bottom wall 4 and side wall 6 of the contactor 1 in the case where larger dimensions should be adopted in order to satisfy an operating capacity where a greater rated power is required.

Therefore, the action of the coil 20 on the rod 21 associated with the control linkage 34 angularly displaces the movable contact 35 towards the fixed pole against the action of the recall spring 27 which intervenes when switching occurs with opening of the contact poles.

It should be pointed out that in the contactor 1 of the present invention the movable pole 35 is guided so as to open always as a result of gravity; in this way, the mass of the movable pole 35 will not affect the operating speed; on the contrary it will favour opening. This also allows calibration of the dimensions and the preload of the resilient recall spring 27.

In the case where several modules should be combined to form a multi-polar contactor, it is sufficient to equip the internal structure with a transverse rod for connecting together the control linkages 34 guiding the poles of the movable contact 35. This rod would form the pivot pin 26 about which the control linkage 34 rotates.

From the above description it is clear how the contactor device 1 according to the present invention solves the technical problem and achieves numerous advantages, in particular that of being able to be installed so as to favour always opening with advantages in terms of the gravity of the movable contact pole.

Moreover, the particular angular form of the arc chute portion for extending the electric arc allows a wide range of contactors to be provided, each with a respective rated operating power, by means of simple structural modifications, for example of the dimensions of the coil of the actuating portion, equipping the contactor with a dissipator of suitable size without modifying, however, the methods of supporting and installing the entire device, owing to the possibility of segment-like insertion into the top projecting corner.

The term "comprising" and derivatives thereof, as used above, are understood as being terms which are open to various interpretations which specify the presence of the characteristics, elements, components, groups, whole elements and/or phases mentioned, but do not exclude the presence of other characteristics, elements, components, groups, whole elements and/or phases which are not mentioned. This concept is also applicable to words which have a similar meaning, for example the terms "have", "include" and derivatives thereof.

The terms "a", "one or more" and "at least one" may be used here interchangeably.

Finally, the qualitative terms such as "substantially", "about", "essentially" and "approximately" as used here indicate a reasonable degree of alteration of the modified term such that the final result is not changed significantly.

The invention claimed is:

1. A mono- or bi-directional contactor device for applications involving switching of a power supply for high current and/or voltage electrical loads, comprising a containing and protective casing made of synthetic plastic insulating material, said casing having a bottom wall from which there extends an actuator portion, said actuator portion comprising a coil and auxiliary contacts, an intermediate portion for housing fixed and movable contact poles, and an upper arc chute portion for dissipating an electric arc;

said casing having a flat parallelepiped form, the bottom wall of the casing extending at 90° with respect to a side wall of the casing, said side wall being on a shorter side of said flat parallelepiped form;

a support plate for the contactor being connected to an outer surface of the bottom wall or to an outer surface of said side wall, so as to support the casing as a vertical extension from a horizontal plane or as a horizontal projection from a vertical plane, and wherein said arc chute portion occupies a quadrant of the parallelepiped form which is situated at a top and/or side with respect to said bottom wall and/or said side wall.

2. Contactor device according to claim 1, wherein the bottom wall of the casing is connected to a side wall via a right-angled corner.

3. Contactor device according to claim 1, wherein said arc chute portion is a segment of predefined angular extension mounted in a quadrant of said parallelepiped shaped casing.

4. Contactor device according to claim 3, wherein said predefined angular extension is a 90° circle segment.

5. Contactor device according to claim 1, wherein the support plate has a longitudinal extension greater than the longitudinal extension of the base or the longitudinal extension or height of said side wall of the casing.

6. Contactor device according to claim 3, wherein said segment is a protrusion at the corner or on the side with dimensions depending on the electric arc dissipation capacity and projecting beyond the side walls of the casing of the contactor, except for the shorter side.

7. Contactor device according to claim 6, wherein said segment has a curved outer surface.

8. Contactor device according to claim 1, wherein it comprises a cavity along at least three sides of the casing for receiving at least one electrical interconnection strip intended to electrically connect respectively the fixed pole or the movable pole to a corresponding terminal part which is accessible on the outside of the contactor for connection to an electrical power supply network.

9. Contactor device according to claim 8, wherein it has two strips, one for the fixed pole and one for the movable pole, said strips being housed inside respective sections of said cavity, and said terminals, i.e. only the free ends of each strip, projecting through associated outlet openings in said casing.

10. Contactor device according to claim 9, wherein said terminals project either from a same side wall of the casing or from opposite side walls.

11. Contactor device according to claim 1, wherein said coil and auxiliary contacts are housed in the actuator portion of the contactor with the longitudinal axis of the coil extending parallel to the bottom wall.

12. Contactor device according to claim 1, wherein said coil has a stem acting on a rod pivotably mounted at a point of said actuator portion and opposite end connected by means of a connecting arm to a control linkage for guiding said movable contact pole.

13. Contactor device according to claim 1, wherein a longitudinal extension of the bottom wall and a height-wise extension of the side wall coincide.

14. Contactor device according to claim 1, wherein it is a magnetic blow-out contactor incorporating a blow-out coil installed in the vicinity of the fixed pole.

15. A mono- or bi-directional contactor device for switching on and off the power supply for high current and/or voltage electrical loads, comprising:

a containing and protective casing made of synthetic plastic insulating material;

said casing having a flat parallelepiped form with at least two lateral walls of the casing extending at 90° one with respect to the other; one of said two lateral walls being on a shorter side of the casing;

an actuator portion including a coil and auxiliary contacts in said casing, an intermediate portion for housing fixed and movable contact poles in said casing, and an arc chute portion for dissipating an electric arc at one end of said casing;

a support plate for the casing connected an outer surface one of said walls so as to support the casing as a vertical extension from a horizontal plane or as a horizontal projection from a vertical plane; and wherein a bottom wall of the casing is connected to a side wall via a right-angled corner.

16. Contactor device according to claim 15, wherein said arc chute portion occupies a quadrant of the parallelepiped form which is situated at the top and/or side with respect to said bottom wall and/or said side wall.

17. Contactor device according to claim 15, wherein said arc chute portion is a segment of predefined angular extension mounted in a quadrant of said parallelepiped shaped casing.

18. Contactor device according to claim 17, wherein said predefined angular extension is a 90° circle segment.

19. Contactor device according to claim 15, wherein the support plate has a longitudinal extension greater than the longitudinal extension of the casing base or the longitudinal extension or height of said side wall of the casing.

20. Contactor device according to claim 17, wherein said segment is a protrusion at the corner or on the side with dimensions depending on the electric arc dissipation capacity and projecting beyond the side walls of the casing of the contactor, except for the shorter side.

21. Contactor device according to claim 20, wherein said segment has a curved outer surface.

22. Contactor device according to claim 15, wherein it comprises a cavity along at least three sides of the casing for receiving at least one electrical interconnection strip intended to electrically connect respectively the fixed pole or the movable pole to a corresponding terminal part which is accessible on the outside of the contactor for connection to an electrical power supply network.

23. Contactor device according to claim 22, wherein it has two strips, one for the fixed pole and one for the movable pole, said strips being housed inside respective sections of said cavity, and said terminals, i.e. only the free ends of each strip, projecting through associated outlet openings in said casing.

24. Contactor device according to claim 23, wherein said terminals project either from a same side wall of the casing or from opposite side walls.

25. Contactor device according to claim 15, wherein said coil and auxiliary contacts are housed in the actuator portion of the contactor with the longitudinal axis of the coil extending parallel to the bottom wall.

26. Contactor device according to claim 15, wherein said coil has a stem acting on a rod pivotably mounted at a point of said actuator portion and opposite end connected by means of a connecting arm to a control linkage for guiding said movable contact pole.

27. Contactor device according to claim 15, wherein a longitudinal extension of the bottom wall and a height-wise extension of the side wall coincide.

28. Contactor device according to claim 15, wherein it is a magnetic blow-out contactor incorporating a blow-out coil installed in the vicinity of the fixed pole.

* * * * *